United States Patent [19]

Yacoboni

[11] Patent Number: 4,716,696

[45] Date of Patent: Jan. 5, 1988

[54] RESILIENT PIER AND FOOTING ARRANGEMENT

[76] Inventor: Joseph Yacoboni, P.O. Box 1606, Lake Placid, Fla. 33852

[21] Appl. No.: 872,487

[22] Filed: Jun. 10, 1986

Related U.S. Application Data

[63] Continuation-in-part of Ser. No. 731,475, May 7, 1985, Pat. No. 4,663,898, which is a continuation-in-part of Ser. No. 199,957, Oct. 25, 1980, abandoned.

[51] Int. Cl.[4] ..... E02D 27/32; E02D 27/34

[52] U.S. Cl. ..... 52/169.9; 52/167; 52/295

[58] Field of Search ..... 52/169.9, 167, 170, 52/DIG. 11, 295, 587, 364, 365; 248/351; 14/16, 75

[56] References Cited

U.S. PATENT DOCUMENTS

| | | | |
|---|---|---|---|
| 752,930 | 2/1904 | Silver | 52/151 |
| 1,530,951 | 2/1925 | Krauss | 52/295 |
| 1,728,164 | 9/1929 | Zureck | 52/295 |
| 1,979,580 | 11/1934 | Spring | 52/295 |
| 2,948,995 | 8/1960 | Cogan | 52/587 |
| 3,906,689 | 9/1975 | Nakayama | 52/167 |
| 4,001,990 | 1/1977 | Chase et al. | 52/167 |
| 4,188,681 | 2/1980 | Tada et al. | 52/167 |
| 4,581,863 | 4/1986 | Thaler | 52/365 |

FOREIGN PATENT DOCUMENTS

| | | | |
|---|---|---|---|
| 968235 | 4/1950 | France | 14/75 |
| 14080 | of 1898 | United Kingdom | 14/16 |

*Primary Examiner*—James L. Ridgill, Jr.

[57] ABSTRACT

The invention relates to a pier and footing arrangement for storm prone and earthquake prone areas. According to the inventive concept, a flat bottom plate is used to be placed in a pre-dug hole. Attached to the plate is an adjustable pipe with a rod and hook-end which connects with a horizontal rod in the pier sleeve which is made of preformed concrete. The upper portion of the pier sleeve holds a steel plate anchor which in turn holds an actuator. Beams from the structure to be supported are coupled to the steel plate anchor.

2 Claims, 3 Drawing Figures

RESILIENT PIER AND FOOTING ARRANGEMENT

This application is a continuation-in-part of U.S. patent application Ser. No. 731,475 filed May 7, 1985 now U.S. Pat. No. 4,663,898 issued May 12, 1987 which in turn is a continuation-in-part of U.S. patent application Ser. No. 199,957 filed Oct. 25, 1980 now abandoned.

BRIEF REVIEW OF THE PRIOR ART

Pier and footing arrangements have been heretofore described in numerous U.S. patents such as: William P. Chase et al U.S. Pat. No. 4,001,990; Jacob Zureck U.S. Pat. No. 1,728,164; Hiroshi Tada et al U.S. Pat. No. 4,188,681; Tadayoshi Nakayama U.S. Pat. No. 3,906,689; George B. Spring U.S. Pat. No. 1,979,580; and, E. W. Krauss U.S. Pat. No. 1,530,951, to mention only a few. It is to be observed that only the Hiroshi Tada et al patent and the Tadayoshi Nakayama patent were invented by people from areas which are earthquake prone. As should be readily apparent but has not too often been considered is the fact that when structures are subjected to typhoon wind pressure, earth tremors, shifting of land caused by attacks from an angry sea, the tremendous forces acting on the structures create paralleolograms and polygons of force, oftentimes, the structures by themselves serving as levers which increase the forces created by nature.

In some of the prior art patents mentioned, rigid footings and piers are used which may be used in many areas but not in areas subject to violent storms and earthquakes. Others are complicated pieces of machinery, difficult to manufacture and difficult to install.

As used herein, the term footing refers to concrete material in the ground, a pier is a unit which is anchored to the footing and includes a concrete sleeve holding other components.

SUMMARY OF THE INVENTION

Generally speaking the present invention contemplates a structural pier having a base plate designed to rest in a horizontal position in a pre-dug ground receiving hole. A steel rod is connected to the base plate having a hook outer-end. The pier has a main body sleeve with a central support rod which will be engaged by the steel rod hook outer-end. The pier main body sleeve is set partially in the footing and partially out the footing which consists of concrete poured into the receiving hole after the pier is fitted therein. At the top of the pier is an anchor plate with appropriate apertures used to hold threaded anchor rods. Disposed over the anchor plate is a substantially hemisphere-shaped actuator which has appropriate bottom fastening means to fasten the actuator to the anchor plate as well as upper fastening means to couple structural beam of the structure which is supported to the actuator.

The invention as well as other objects and advantages thereof will become more apparent from the following detailed description when taken together with the accompanying drawings, in which:

DETAILED DESCRIPTION

Figure 1:
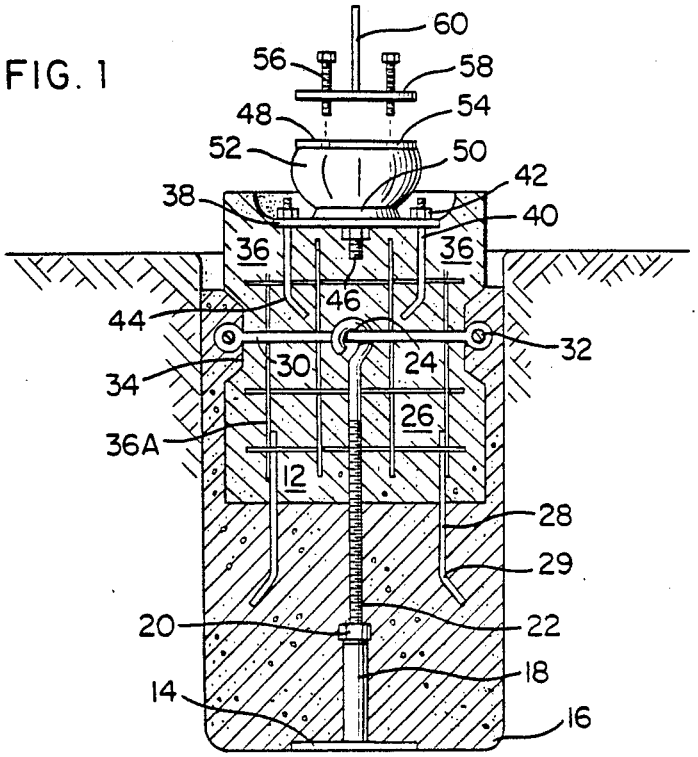
FIG. 1 shows a partly perspective partial sectional view of the arrangement contemplated.

Shown in the drawings is a pier footing arrangement 10. In this description, concentration will first be directed to the portion of the drawing relating to the pier 12 and the pier lower anchor arrangement. This consists of a base plate 14 which rests horizontally in a pre-dug ground receiving hole 16. As shown in FIG. 1, coupled to the center of the base plate 14 is a steel pipe 18 which extends from one to three feet above the ground bottom of the pre-dug ground receiving hole 16 as shown in FIG. 1. At the upper end of the steel pipe 18 is a nut 20 welded to the pipe so as to receive a threaded rod 22, or a rod with a threaded portion at the lower end. This threaded or partially threaded rod 22 has a hook or eyelet at the upper end 24.

The upper portion of rod 22 is firmly held in a concrete sleeve 26. Sleeve 26 may be formed either as a rectangular block or a cylindrical shape with indentations 34 as shown in FIG. 1. At the bottom of concrete sleeve 26 are several vertical bars 28 with bar ends 29 which are outwardly bent. In the center portion of the sleeve is a wire mesh 36A and horizontal support rod 30 with eyelets 32 at the outer ends of support rod 30. Concrete sleeve 26 has indentations 34 to receive these eyelets 32. Although the vertical threaded rod 22, the horizontal support rod 30 and the welded nut 20 are firmly held, a certain amount of flexibility is provided by this arrangement sufficient to withstand forces of storm and earth tremors. Above the indentations 34 is the upper portion 36 of the pier 12 which may be, but not necessarily is located above the ground surface.

In the upper portion 36 is embedded an upper anchor plate 38. Plate 38 has several apertures, preferably towards its outer perimeter which are used for embedding, by receiving threaded rods 40. These rods 40 are held by bolts 42 to the anchor plate and the rods 40 are then embedded into the concrete sleeve upper portion 36. The rods 40 have inwardly bent inner ends 44. At the center of the anchor plate 38 is an aperture for receiving a strong nut and bolt 46 which will hold an actuator 48.

The actuator 48, also called an air-stroke actuator is of almost hemispherical shape. The flat portion being on top and the rounded portion contacting the anchor plate 38.

The center of the rounded portion of the actuator 48 lies in a retaining dish 50. A nut and bolt 46 passes through the rounded bottom of the actuator 48, dish 50 and anchor plate 38 holding the actuator to the anchor plate. The flat top portion 52 over the actuator has apertures 54 and nuts held therein for receiving bolts 56 holding the bottom plate 58 of an I-beam 60 which is part of the structure being supported.

In carrying the invention into practice, use is made of the steel frame and base usually found in factory built mobile homes, or the lower frame of a tower. These parts usually already have holes which are used to secure the structure. In some cases straps are used in connection with these holes, but this is very poor coupling and not secure, even when steel reinforced straps are used. The arrangement just described when in place can deflect a 90 mile wind by bending the structure just sufficiently to give way before such a wind.

Figure 3:
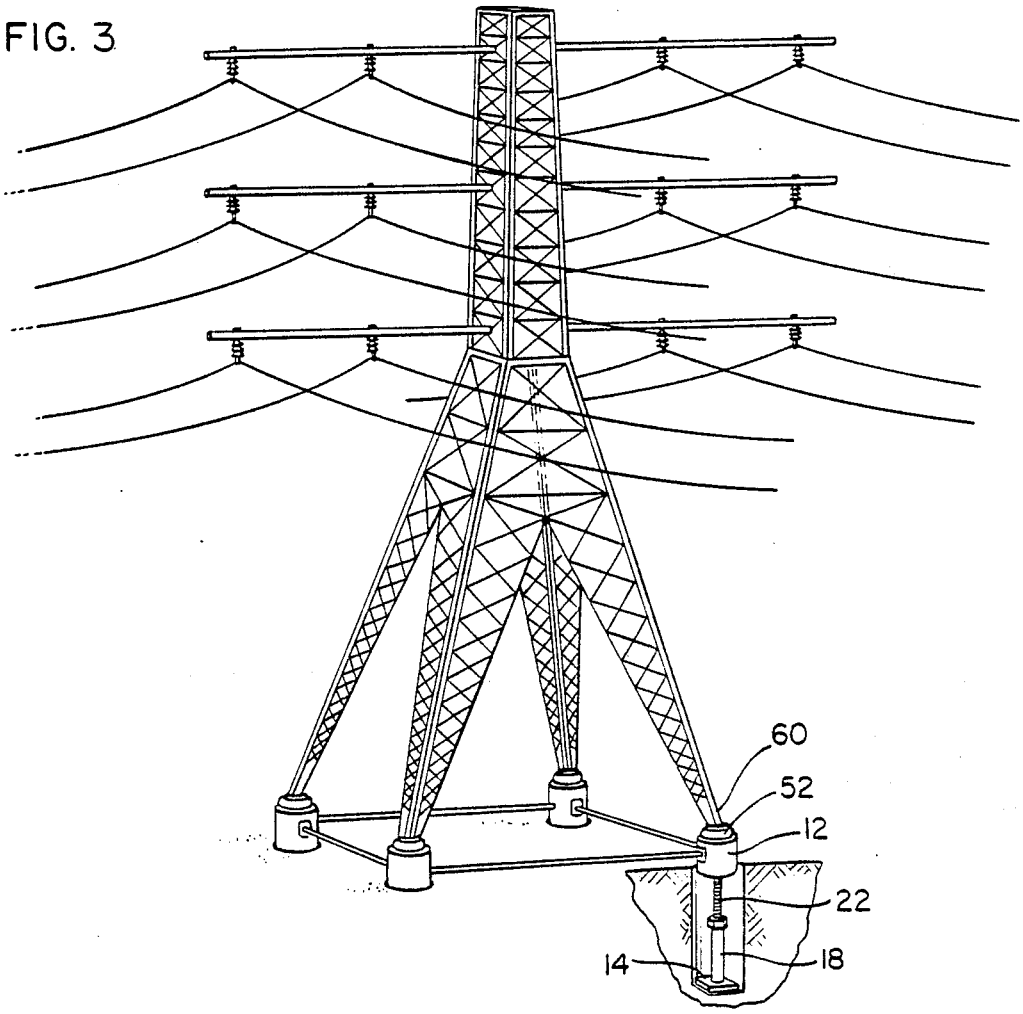
FIG. 3 illustrates the use of the arrangement contemplated herein in connection with a tower structure.
Figure 2:
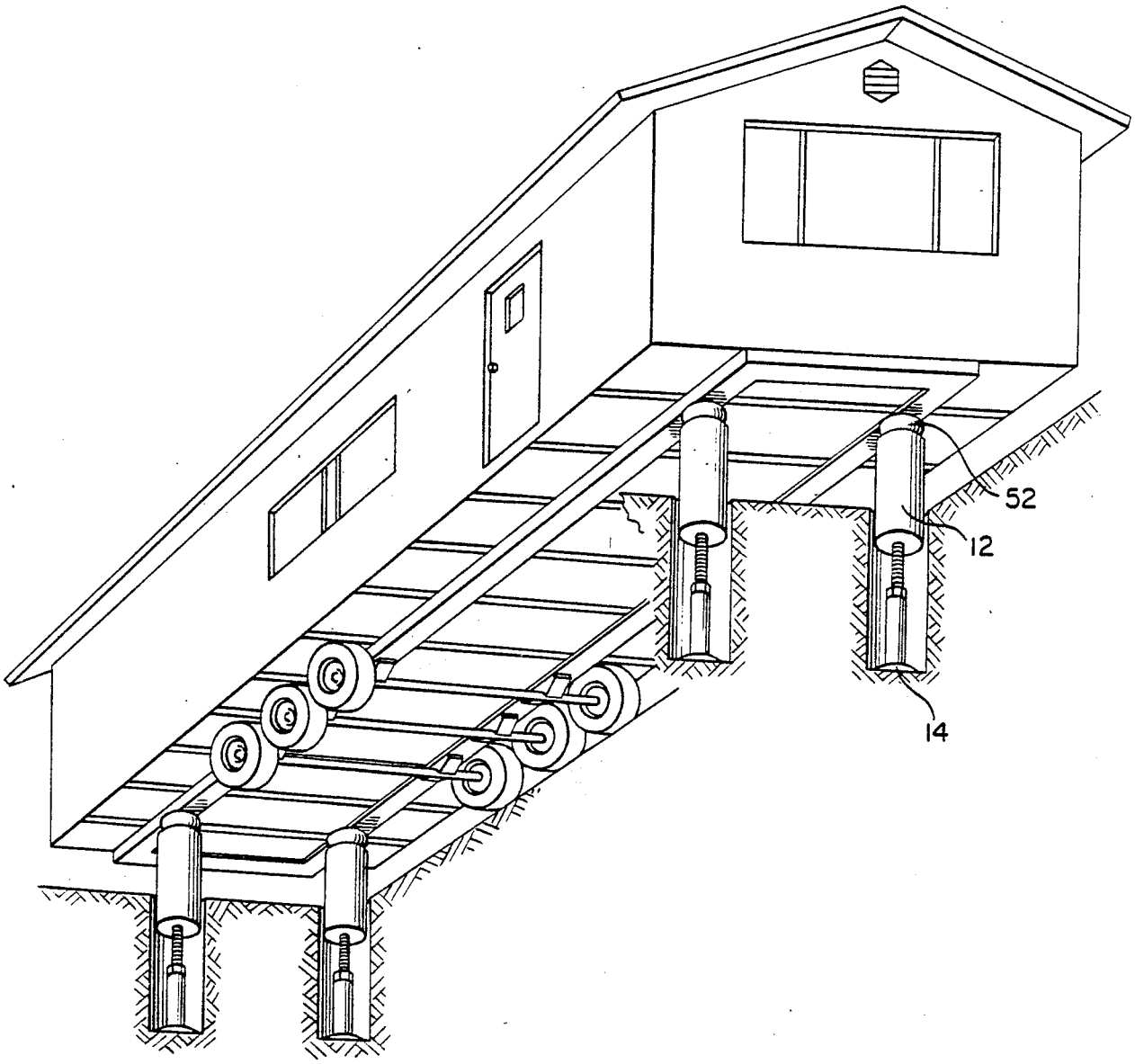
FIG. 2 depicts the underside of a mobile home which uses the arrangement contemplated herein.

The pier, with its sleeve, base plate and actuator are built in a shop before installation and in fact can be made available as an off-the-shelf stock item. As shown in FIG. 2 and FIG. 3, a proper size hole is first dug in the ground at each location where a pier is to be placed in a footing. This work is done in fiberglass molds. On site forming is not needed. In molding the pier, wire-mesh is used after the rods and bars are all in place and before pouring the concrete into the mold. When erecting a structure, or using the arrangement for an existing structure, the base plate is placed into the pre-dug hole, the threaded rod 22 is adjusted into the pipe 18 and locked into place. In pier 12 should be so disposed that its upper portion 36 is above the ground. Concrete is then poured into the pre-dug hole to provide the footing for the pier 12. The structure to be supported is then coupled to the pier by the nuts and bolts 56.

It is to be observed therefore that the present invention provides for a pier and footing arrangement for storm prone and earthquake prone areas. The arrangement generally includes a flat bottom plate used to rest on the bottom of the pre-dug hole. An adjustable pipe is attached to the flat bottom plate with a rod disposed to threadedly engage the pipe. The end of the pipe has an eyelet used to connect it to a horizontal rod in the pier sleeve. The pier and its sleeve is made of preformed concrete and has at its center portion the aforementioned horizontal steel rod. The pier has an upper portion which holds a steel plate anchor. A semispherical actuator is disposed on the steel plate anchor and is firmly connected thereto by firm fastening means, which hold the rounded bottom of the actuator to the steel plate anchor. The top flat portion of the actuator has fastening means to fasten the pier to a supported structure.

The entire pier is dropped into the pre-dug hole as a unit and concrete for the footing is then poured in. The flat bottom plate connected to the steel pipe which has a nut welded to it is first placed into the pre-dug hole and the pipe with its nut can then accept the threaded rod, allowing the pier to be raised or lowered by turning the top of the pier clockwise to lower it and counter-clockwise to raise it. The actuator holes are lined up with the structure frame and bolted tightly.

What is claimed is:

1. As an article of manufacture, a prefabricated concrete structural pier, which, when placed in a pre-dug aperture in the ground, of proper size and shape will support at least a portion of a structure, said pier comprising in combination:

(a) a base plate (14) with a defined center, said plate being designed to rest in a horizontal position at the bottom of a pre-dug aperture in the ground;

(b) a vertical pipe (18), connected to said plate center, with an internally threaded bolt (20) welded to the upper end thereof;

(c) a vertical steel rod (22), threaded at its lower end and threadedly engaged to said bolt (20) so that the rotation of the rod will adjust the heighth of said rod, said rod having a hook upper end;

(d) a vertical concrete-filled sleeve (26), serving to define the pier main body, a central support rod (30) extending horizontally across said vertical sleeve (26) at about its widest part, said support rod (30) being engaged by said hook upper end so that the rotation of said rod determines the vertical location of the vertical concrete-filled sleeve (26);

(e) an anchor plate (38) embedded at the top of the pier having a defined central section, with appropriate outer apertures, also with downwardly extending threaded anchor rods (40) held in said apertures, inwardly bent outer ends on said anchor rods;

(f) a substantially hemisphere-shaped actuator (48) with a round portion and a flat portion, the round portion thereof being fastened to the anchor plate central section, the flat portion having apertures therein to receive fastening means for a structural beam; and, (g) a plurality of vertical bars (28) with outwardly bent ends extending out of the bottom of the sleeve to hold the sleeve firmly in concrete to be poured around the pier.

2. A structural pier as claimed in claim 1, said actuator including a central nut and bolt holding the rounded portion of the actuator to the anchor plate.

* * * * *